US010407260B2

(12) United States Patent
Murakami et al.

(10) Patent No.: US 10,407,260 B2
(45) Date of Patent: Sep. 10, 2019

(54) SHEET FEEDING APPARATUS AND IMAGE FORMING APPARATUS

(71) Applicant: CANON KABUSHIKI KAISHA, Tokyo (JP)

(72) Inventors: Atsushi Murakami, Kawasaki (JP); Daisuke Aoki, Yokohama (JP); Yu Shuhama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/909,550

(22) Filed: Mar. 1, 2018

(65) Prior Publication Data

US 2018/0186586 A1 Jul. 5, 2018

Related U.S. Application Data

(63) Continuation of application No. 15/167,023, filed on May 27, 2016, now Pat. No. 9,938,097.

(30) Foreign Application Priority Data

Jun. 2, 2015 (JP) ..... 2015-112588

(51) Int. Cl.

| | |
|---|---|
| ***B65H 3/06*** | (2006.01) |
| ***B65H 3/54*** | (2006.01) |
| ***B65H 7/00*** | (2006.01) |
| ***G03G 15/00*** | (2006.01) |

(52) U.S. Cl.

CPC ..... *B65H 3/0684* (2013.01); *B65H 3/54* (2013.01); *B65H 7/00* (2013.01); *G03G 15/6511* (2013.01); *G03G 2215/00679* (2013.01)

(58) Field of Classification Search

CPC ..... B65H 2405/324; B65H 2405/354; B65H 2407/21; B65H 2553/44; B65H 3/0607; B65H 3/0661; B65H 5/26; B65H 3/0684; B65H 3/54

See application file for complete search history.

(56) References Cited

U.S. PATENT DOCUMENTS 7,726,804 B2 * 6/2010 Takeuchi ..... B41J 13/103 347/104
2016/0090253 A1 * 3/2016 Sano ..... B65H 5/26 271/3.19

FOREIGN PATENT DOCUMENTS

JP 2000-159360 A 6/2000

* cited by examiner

*Primary Examiner* — Thomas A Morrison
(74) *Attorney, Agent, or Firm* — Canon U.S.A. Inc., IP Division

(57) ABSTRACT

A cut-out is provided in a lower guide so as to permit a return claw to move between a retracted position and a protruded position. Furthermore, an upper surface of the return claw positioned in the protruded position functions as a guide portion that guides an underside of a sheet that has been manually fed.

11 Claims, 8 Drawing Sheets

SHEET FEEDING APPARATUS AND IMAGE FORMING APPARATUS

CROSS-REFERENCE TO RELATED APPLICATIONS

This application is a continuation of U.S. application Ser. No. 15/167,023 filed May 27, 2016, which claims the benefit of Japanese Patent Application No. 2015-112588 filed Jun. 2, 2015, each of which is hereby incorporated by reference herein in its entirety.

BACKGROUND OF THE INVENTION

Field of the Invention

The present disclosure relates to a sheet feeding apparatus and an image forming apparatus.

Description of the Related Art

An image forming apparatus is known that includes, other than a cassette feed portion for feeding a sheet that is stacked on a feeding cassette, a manual feed portion for manually feeding a sheet according to the intended use. Such an image forming apparatus is known to be configured to have a conveyance path of the sheet fed by the manual feed portion merge with a conveyance path of the sheet fed by the cassette feed portion.

Japanese Patent Laid-Open No. 2015-20884 discloses a configuration in which a conveyance path for manual feed is provided above a feeding cassette. Furthermore, Japanese Patent Laid-Open No. 2015-20884 discloses a configuration in which, when manually feeding, a feed roller that feeds a sheet in the feeding cassette is retracted upwards.

However, in the configuration described in Japanese Patent Laid-Open No. 2015-20884, when manual feeding is performed, there are cases in which the sheet stacked in the feeding cassette is dragged out, causing multi-feeding. More specifically, for example, when the sheet fed from the feeding cassette remains near a separation portion, there are cases in which the manually fed sheet drags out the sheet.

SUMMARY OF THE INVENTION

The present disclosure provides a feeding apparatus, including a stack portion on which a sheet is stacked, a first feed member capable of moving between a first position in which the sheet stacked on the stack portion is fed and a second position that is a position where the first feed member that has moved upwards from the first position is positioned, the first member being capable of feeding the sheet to a first conveyance path, a separation member that separates a sheet fed by the first feed member, a second feed unit that is provided above the stack portion and that is capable of feeding the sheet, the sheet conveyed through a second conveyance path is made to enter the first conveyance path with the second unit, and a moving member that moves from a retracted position in which the moving member is retracted from the first conveyance path to a protruded position in which the moving member is protruded into the first conveyance path. In the feeding apparatus, the second feed unit feeds the sheet while in a state in which the moving member is positioned in the protruded position.

Further features of the present invention will become apparent from the following description of exemplary embodiments with reference to the attached drawings.

DESCRIPTION OF THE EMBODIMENTS

First Exemplary Embodiment

Figure 1:
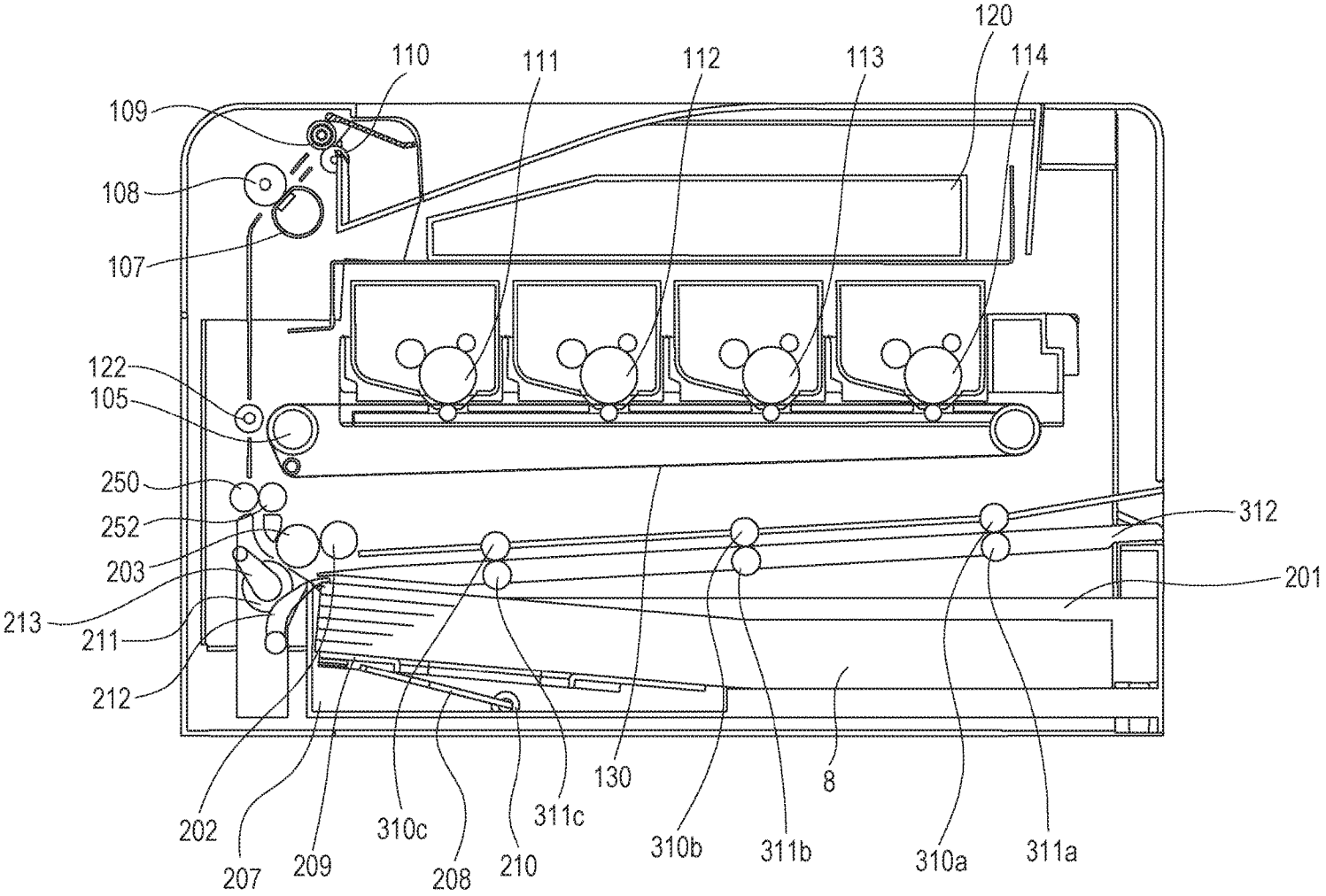
FIG. 1 is a schematic cross-sectional view of an image forming apparatus.

Referring to the drawings, a first exemplary embodiment of the present disclosure will be described. The description will be given in the order of an overall structure of an image forming apparatus, an attaching/detaching method of a process cartridge, a configuration of the process cartridge, and a configuration of a cartridge cassette. Herein, a laser beam printer is illustrated as an example of the image forming apparatus. Furthermore, an image forming apparatus in which toner images on a belt are transferred at once on a sheet after the toner images of each color on photosensitive drums are sequentially transferred onto the belt is illustrated as an example.

Overall Structure of Image Forming Apparatus

Referring to FIG. 1, an outline of an overall structure of the image forming apparatus will be described. FIG. 1 is a schematic cross-sectional view of the image forming device. A sheet 8 that is stacked in a feeding cassette 201 is fed by a feed roller (a first feed member) 202 that rotates clockwise in the drawing. The sheet 8 that has been fed is sent to a nip portion between a conveyance roller 250 and a conveyance facing roller 252, and is sent to a nip portion (a transfer portion) between an in-belt roller 105 and a transfer roller 122.

Photoconductive drums 111, 112, 113, and 114 serving as image carrying members constituting image forming portions rotate anticlockwise in the drawing. In the image forming portions, electrostatic latent images are sequentially formed on outer peripheral surfaces of the photosensitive drums with a laser beam from a laser scanner 120 and, subsequently, the electrostatic latent images are developed by development rollers so that toner images are formed. The toner images formed on the photosensitive drums 111, 112, 113, and 114 are transferred onto an intermediate transfer belt 130. When forming a color image, toner images of various colors, namely, yellow, magenta, cyan, and black are developed on the photosensitive drums 111, 112, 113, and 114, and the formed toner images are sequentially transferred onto the intermediate transfer belt 130. Subsequently, the toner images formed on the intermediate transfer belt 130 are transferred at once on the sheet 8 that has been sent to the nip portion between the in-belt roller 105 and the transfer roller 122.

Furthermore, the sheet 8 on which the toner images have been transferred is sent to a nip portion (a fixing portion) between a fixing film 107 and a pressure roller 108 and is heated and compressed such that the toner images are fixed to the sheet 8. The sheet 8 on which the toner images have been fixed is discharged to the outside of an apparatus body with a discharge roller 109 and a discharge roller 110.

Configuration of Feeding Apparatus

The feeding cassette 201 includes a cassette frame 207, a pivotal stack portion 209 attached to the frame 207, and a lift arm 208 for lifting the stack portion 209. The feeding cassette 201 is provided so as to be capable of being drawn out and inserted into the apparatus body from the front side (the right side in FIG. 1) of the apparatus.

A drive transmitted to the lift arm 208 after the feeding cassette 201 is inserted into the apparatus body pivots the stacking portion 209 on which the sheet 8 has been stacked about a rotating shaft 210 so as to lift the stack portion 209 to a position enabling the sheet 8 to be fed.

Figure 2:
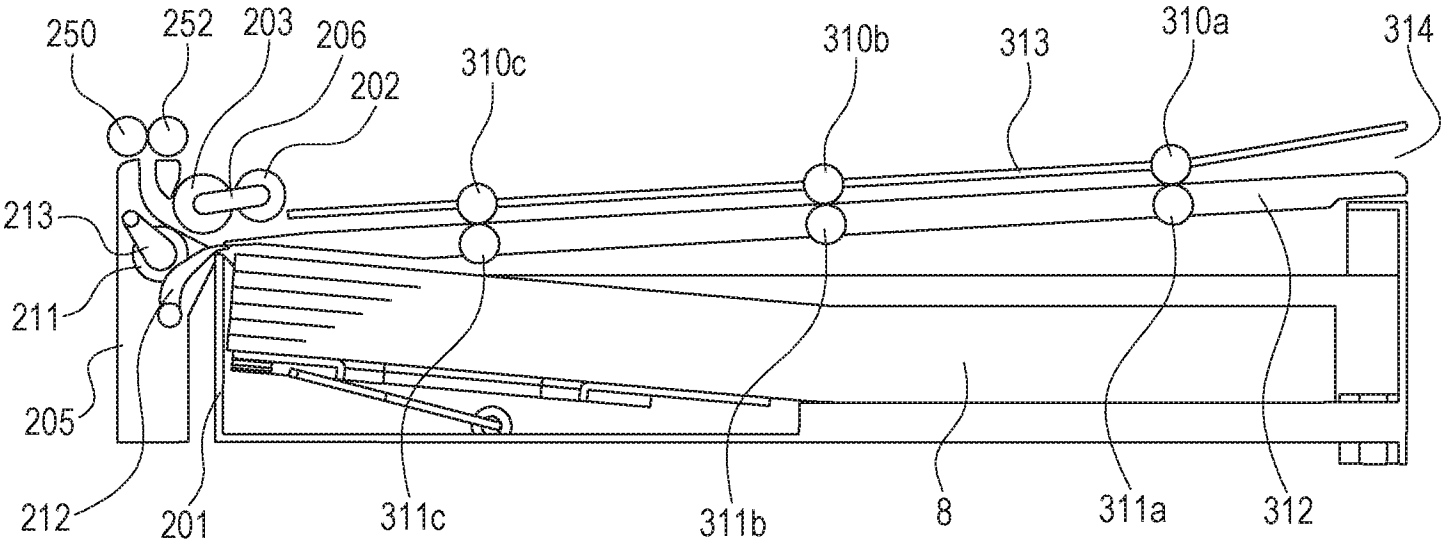
FIG. 2 is a cross-sectional view of a sheet feeding apparatus of a first exemplary embodiment.
Figure 3:
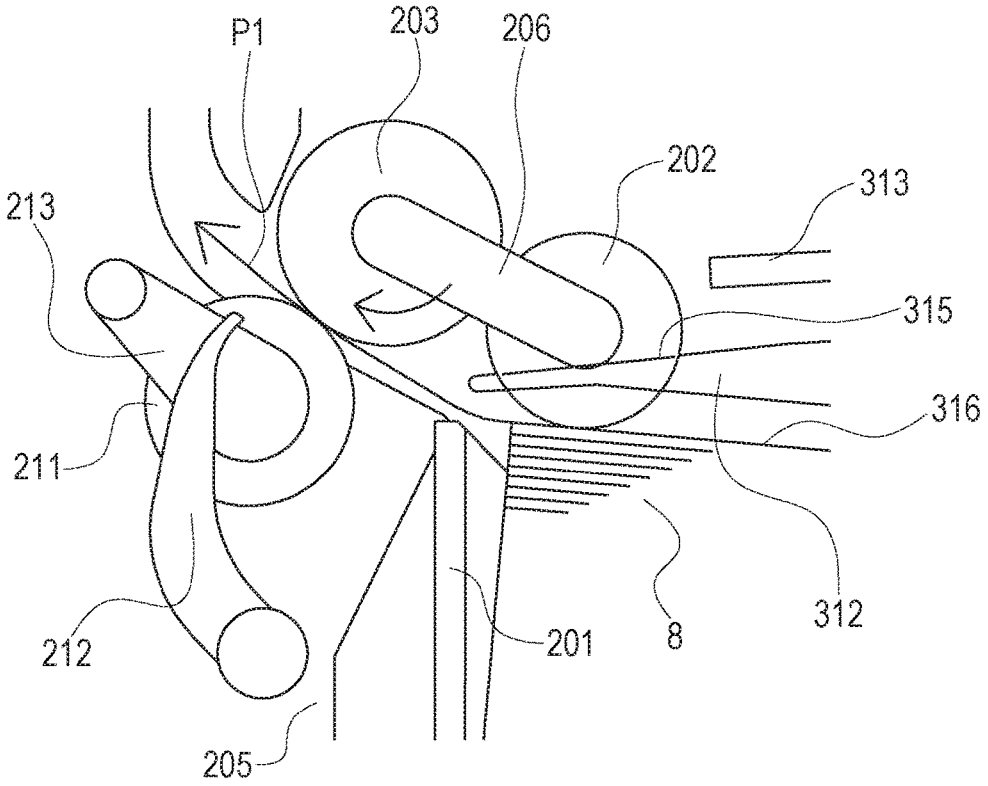
FIG. 3 is a diagram for describing an operation of the sheet feeding apparatus according to the first exemplary embodiment.
Figure 4:
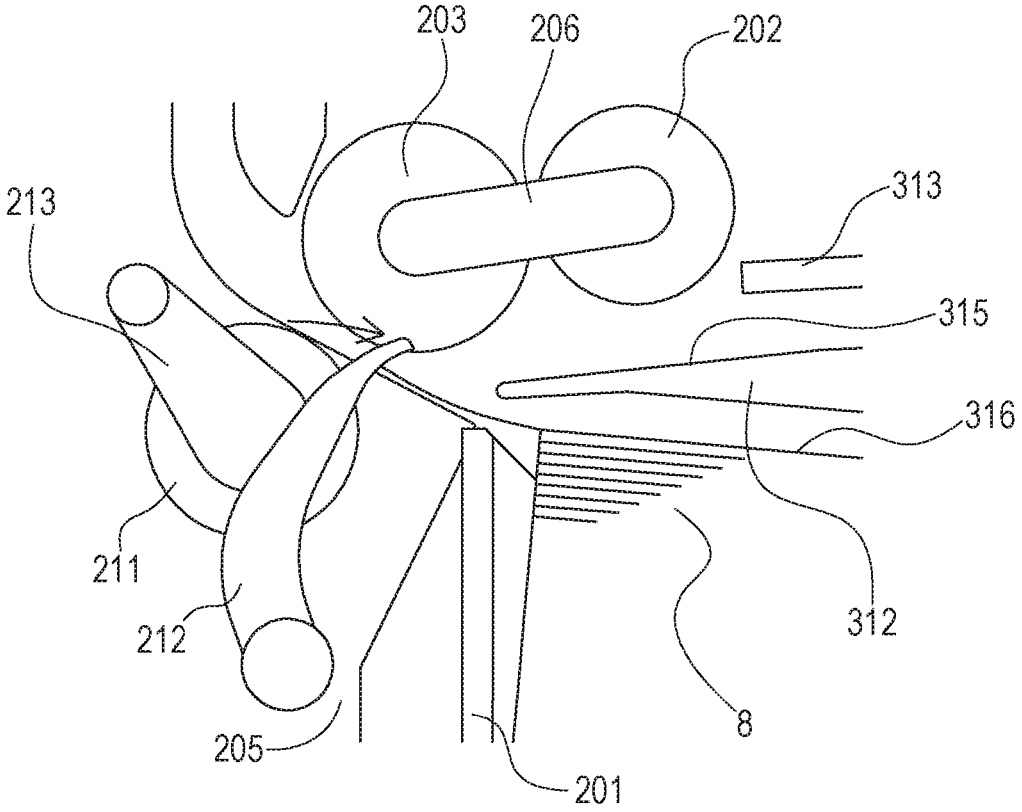
FIG. 4 is a diagram for describing an operation of the sheet feeding apparatus according to the first exemplary embodiment.
Figure 5:
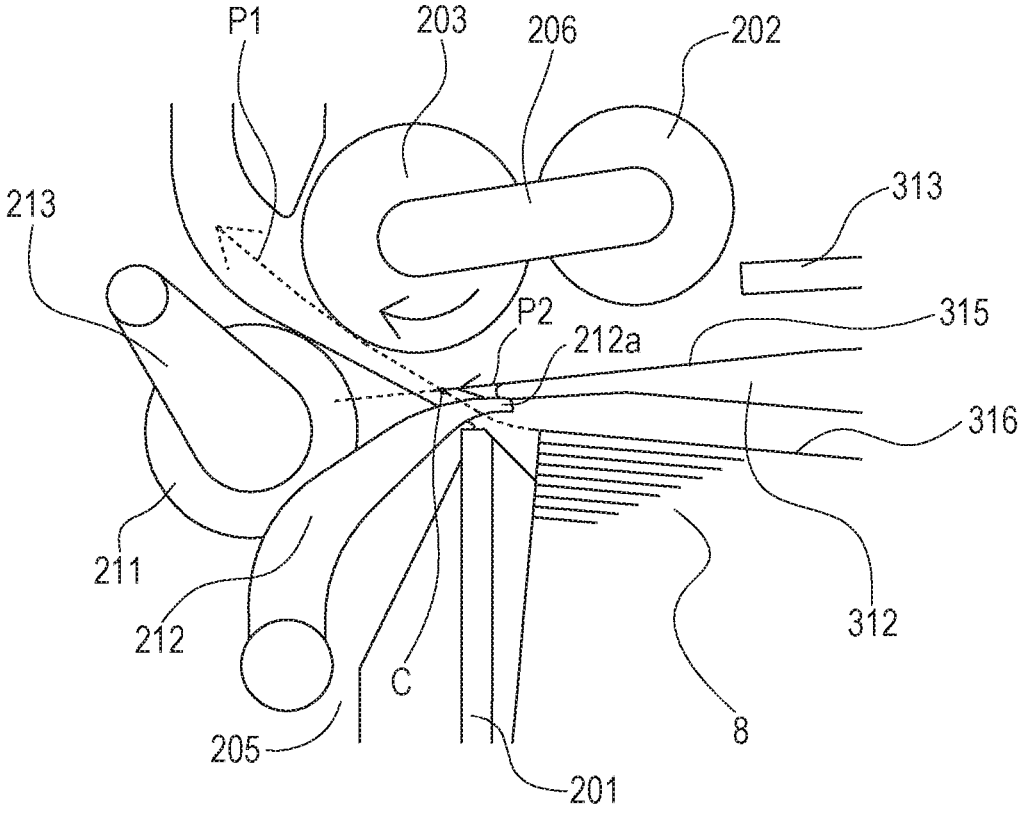
FIG. 5 is a diagram for describing an operation of the sheet feeding apparatus according to the first exemplary embodiment.
Figure 6:
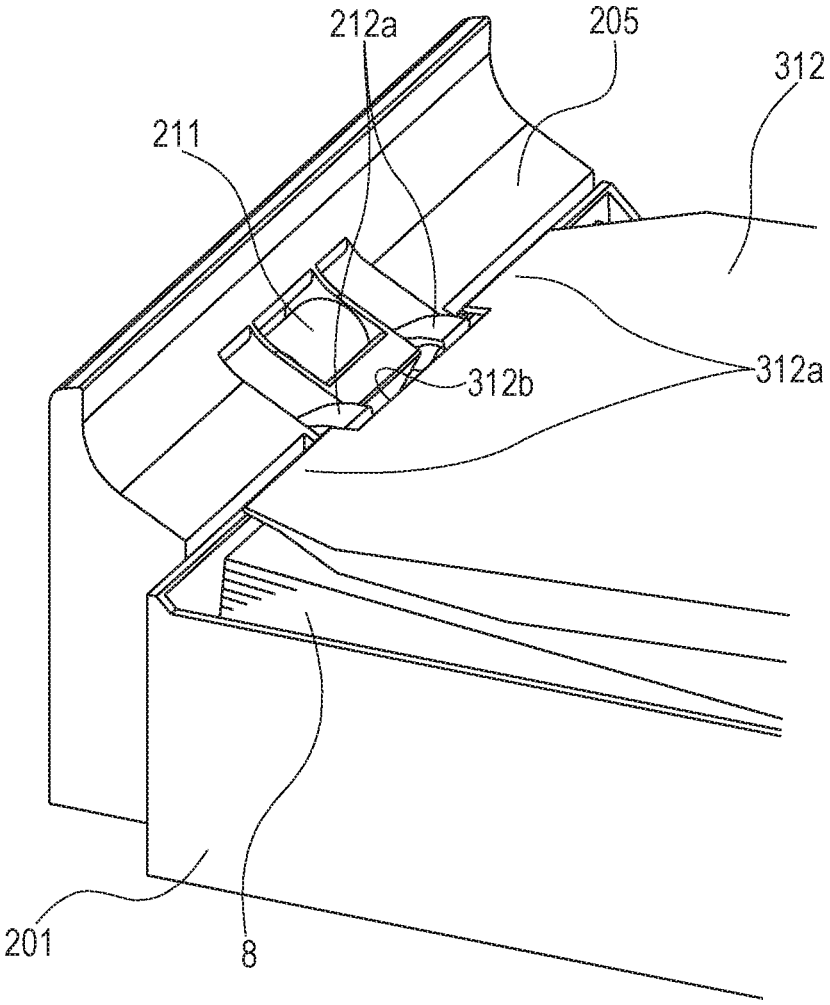
FIG. 6 is a diagram for describing an operation of the sheet feeding apparatus according to the first exemplary embodiment.

FIG. 2 is a cross-sectional view of a sheet feeding apparatus of the first exemplary embodiment. FIG. 3 is a drawing for describing an operation of feeding the sheet 8 from the cassette 201. FIGS. 4 and 5 are drawings for describing an operation of a return claw 212. FIG. 6 is a perspective view of the feeding apparatus of the first exemplary embodiment in a state in which the return claw 212 is in a protruded position.

A configuration and an operation of the cassette feed portion will be described first. In FIG. 2, the feed roller 202 is supported by a support member 206 that is capable of moving pivotally in the up-down direction about an axis of a feed roller (a conveyance member) 203. The feed roller 202 is capable of moving between a position (a first position) where the feed roller 202 is in contact with the uppermost surface of the sheets 8 that are inside the feeding cassette 201 and that are stacked on the stack portion 209, and a position (a second position) separated from the uppermost surface. When in a non-feeding state, the feed roller 202 retracted upwards. When feeding the sheet 8, the support member 206 pivots downwards about the axis of the feed roller 203, and a drive is transmitted to the feed roller 203 and the feed roller 202. With the pivoting operation of the support member 206, the feed roller 202 comes in contact with the uppermost surface of the sheets 8, and a sheet 8 is fed (FIG. 3).

The sheet 8 is sent into a separating nip portion between the feed roller 203 and a separation roller (a separation member) 211 with the feed roller 202, and the feed roller 202 retracts upwards until the next feed operation is performed. In the above, when only a single sheet 8 is sent out, since a large rotational torque is transmitted to the separation roller 211, the separation roller 211 and a torque limiter (not shown) rotate together with the feed roller 203. Conversely, when two or more sheets 8 are fed by the feed roller 202, since only frictional force between the sheets 8 is transmitted to the separation roller 211, the torque limiter does not rotate and the second sheet 8 is stopped at the nip portion. With the above, the sheets 8 can be separated from each other.

Furthermore, the feeding apparatus of the first exemplary embodiment includes the return claw (a moving member) 212 that returns the sheet 8 near the separating nip portion towards the upstream side in the feed direction. The return claw 212 moves the sheet 8 near the separation roller 211 towards the upstream side by moving from a retracted position (FIG. 3) where the return claw 212 is retracted below a conveyance path P1, which is a path in which the sheet 8 is fed by the feed roller 202, to the protruded position (FIG. 5) where the return claw 212 protrudes into the conveyance path P1. Note that FIG. 4 is a drawing illustrating a state in which the return claw 212 is in the course of moving from the retracted position illustrated in FIG. 3 to the protruded position illustrated in FIG. 5.

A configuration and an operation of the manual feed portion will be described next. A conveyance path of the manual feed portion is formed by a lower guide (a second guide portion) 312 and an upper guide 313. As illustrated in FIG. 5, an end portion of the lower guide 312 is configured so that the sheet 8 is conveyed on a conveyance path P2. The conveyance path P2 coincides with a straight line that come in contact with a guide surface 315 of the lower guide 312. The conveyance path P1 and the conveyance path P2 intersect each other at point C illustrated in FIG. 5. Point C is, in the conveyance direction, located downstream of the feed roller 202 and downstream of an uppermost surface 316 of the sheets 8. Furthermore, point C is located upstream of the separating nip portion in the conveyance direction.

When feeding is performed manually, the user inserts a sheet 8 into a manual feed port 314 (FIG. 2), and the sheet 8 is conveyed downstream with manual conveyance rollers 310*a* and 311*a*. The sheet 8 that is conveyed with conveyance rollers 310*b*, 311*b*, 310*c*, and 311*c* is conveyed along the conveyance path formed by the lower guide 312 and the upper guide 313. Furthermore, the sheet 8 enters the conveyance path P1 at a portion downstream of the feed roller 202 and is conveyed to the separating nip portion between the feed roller 203 and the separation roller 211. In the above, the feed roller 202 is retracted upwards from the uppermost surface 316 of the sheet 8, and the sheet 8 is guided by the guide surface 315 and is conveyed on the conveyance path P2. Furthermore, when feeding is performed manually, the separation roller 211 that is supported by a separation roller support member 213 is separated from the feed roller 203. Subsequently, an image is formed after the sheet 8 arrives at the nip portion between the conveyance roller 250 and the conveyance facing roller 252. In other words, the separation roller 211 is capable of moving between a contact position that is in contact with the feed roller 203 and a separated position that is separated from the feed roller 203. In a state in which the separation roller 211 is in the contact position, the separation roller 211 can separate the sheet 8 fed from the cassette 201.

Furthermore, as illustrated in FIG. 6, the downstream end portion of the lower guide 312 forms a pectinate shape with the return claw 212 that is stationary at the protruded position (FIG. 5). In other words, the return claw 212 and the lower guide 312 overlap each other in the conveyance direction. A cut-out (a recess) 312*b* is provided in the lower guide 312 so as to permit the return claw 212 to move between the retracted position and the protruded position. Furthermore, an extended portion 312*a* that guides the underside of the sheet 8 is provided in the lower guide 312 at a position that is the same as that of the cut-out 312*b* in the feed direction and at a position that is different from that of the cut-out 312*b* in the width direction (a direction that is orthogonal to the feed direction) of the sheet 8. Furthermore, the upper surface of the return claw 212 that is positioned in the protruded position functions as a guide portion (a first guide portion) 212*a* that guides the underside of the manually fed sheet 8. Note that the return claw 212 positioned in the protruded position is positioned above the uppermost surface of the sheets 8 stacked in the stack portion 209.

As illustrated in FIGS. 5 and 6, in the configuration of the first exemplary embodiment, the downstream end portion of the lower guide 312 is positioned higher than the upstream end portion of the return claw 212 in the protruded position and overlaps the return claw 212 in a pectinate manner. With the above, the upper surface of the return claw 212 positioned in the protruded position forms a continuous conveyance path from the lower guide 312. Since the return claw 212 has a guide portion 212*a* at its upper surface and since there is an overlap between the return claw 212 and the lower guide 312 in the conveyance direction, the sheets 8 in the cassette 201 can be prevented from being dragged out.

Figure 7:
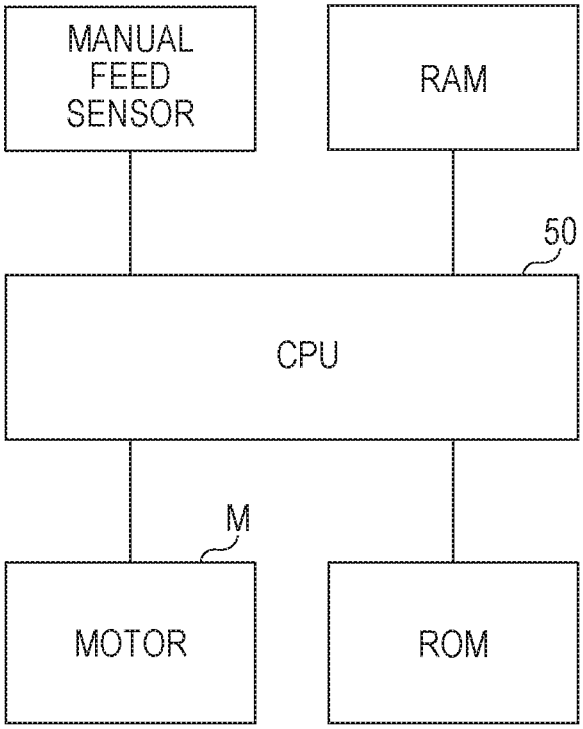
FIG. 7 is a block diagram of the first exemplary embodiment.

Description of a block diagram of the first exemplary embodiment will be given next. As illustrated in FIG. 7, a CPU (a control unit) 50 is connected to a manual feed sensor, a motor (a driving device) M, a ROM, and a RAM. In the first exemplary embodiment, the CPU 50 drives the motor M so that the feed roller 202 moves up and down and rotates, the return claw 212 moves between the retracted position and the protruded position, and the separation roller 211 is separated. In other words, the CPU 50 retracts the feed roller 202 upwards, positions the return claw 212 at the protruded position, and rotates the manual conveyance roller while the separation roller 211 is separated from the feed roller 203 so as to feed the sheet 8. Note that in the present disclosure, the feed roller 202, the return claw 212, and the separation roller 211 may be provided with actuators, such as motors, each moving the corresponding one of the feed roller 202, the return claw 212, and the separation roller 211.

Furthermore, when the manual feed sensor detects that a user has inserted (stacked) a sheet 8 or sheets 8 through the manual feed port 314, the CPU 50 rotates the manual conveyance rollers 310*a*, 310*b*, 310*c*, 311*a*, 311*b*, and 311*c*. Note that a second feed unit is configured by the conveyance path P2 for conveying the sheet 8 from the manual feed port 314 to the feed roller 202, and the manual conveyance rollers 310*a*, 310*b*, 310*c*, 311*a*, 311*b*, and 311*c*. Note that the conveyance path P1 is a first conveyance path, and the conveyance path P2 is a second conveyance path. The conveyed sheet 8 is conveyed downstream and stopped at a stand-by position. With the above, the image forming apparatus is set to a stand-by state capable of accepting print jobs that feeds the sheet from the manual feed portion. Note that in the above case, the stop position of the front end portion of the sheet 8 is upstream of the cut-out 312*b*.

As describe above, the first exemplary embodiment is capable of stably feeding the sheet 8 fed from the manual feed portion by using the return claw 212 for returning the sheet 8 fed form the cassette feed portion towards the upstream side.

Figure 8:
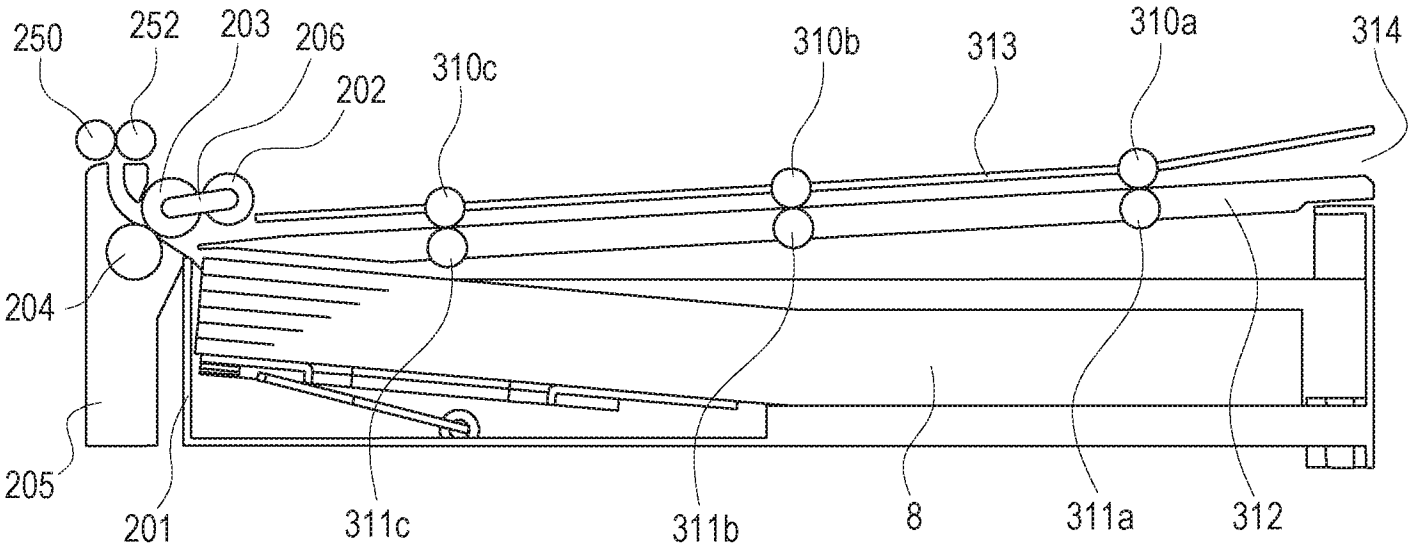
FIG. 8 is a diagram illustrating a configuration in which a retard roller is used in place of a separation roller.

Note that in the present disclosure, in place of the separation roller 211, a retard roller 204 that is illustrated in FIG. 8 and that is capable of reverse rotation with respect to the conveyance direction may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A sheet feeding apparatus, comprising:

a stack portion on which a sheet is stacked;

a first feed member capable of moving between a first positon in which the sheet stacked on the stack portion is fed and a second position where the first feed member that has moved upwards from the first position is positioned;

a separation member that separates a sheet fed by the first feed member;

a guide portion provided above the stack portion;

a second feed member that is provided above the stack portion and that is capable of feeding a sheet guided by the guide portion toward the separation member; and a moving member movable to a protruded position where the moving member is protruded toward the guide portion and a retracted position where the moving member is retracted from the protruded position toward the separation member, wherein the moving member moves the sheet near the separation member towards an upstream side in a feed direction by moving from the retracted position to the protruded position, and wherein the second feed member feeds the sheet guided by the guide portion and the moving member in a state in which the moving member is positioned in the protruded position.

2. The sheet feeding apparatus according to claim 1, wherein the moving member includes another guide portion that guides an underside of the sheet fed by the second feed member.

3. The sheet feeding apparatus according to claim 1, wherein the guide portion does not guide the underside of the sheet fed by the first feed member.

4. The sheet feeding apparatus according to claim 1, wherein a recess that permits the moving member to move is formed in the guide portion.

5. The sheet feeding apparatus according to claim 4, wherein the guide portion includes an extended portion, the extended portion guiding the underside of the sheet, at a position that is the same as a position of the recess in a feed direction and at a position that is different from a position of the recess in a sheet width direction orthogonal to the feed direction.

6. The sheet feeding apparatus according to claim 1, wherein the moving member positioned in the protruded position is positioned above an uppermost surface of the sheet stacked on the stack portion.

7. The sheet feeding apparatus according to claim 1, wherein the second feed member includes an opening portion, the second feed member feeding the sheet inserted into the opening portion.

8. An image forming apparatus, comprising:

the sheet feeding apparatus according to claim 1, and an image forming portion that forms an image on the sheet that has been separated by the separation member.

9. The sheet feeding apparatus according to claim 1, further comprising:

a conveyance member that opposes the separation member and that conveys the sheet, wherein the separation member is capable of moving between a contact position in which the separation member abuts against the conveyance member, and a separated position in which the separation member is separated from the conveyance member.

10. The sheet feeding apparatus according to claim 9, further comprising:

a control unit that controls the first feed member, the second feed member, and the moving member, wherein the control unit feeds the sheet with the second feed member in a state in which the first feed member is retracted upwards, the moving member is positioned in the protruded position, and the separation member is separated from the conveyance member.

11. A sheet feeding apparatus, comprising:

a stack portion on which a sheet is stacked;

a first feed member capable of moving between a first positon in which the sheet stacked on the stack portion is fed and a second position where the first feed member that has moved upwards from the first position is positioned;

a separation member that separates a sheet fed by the first feed member;

a conveyance member that opposes the separation member and that conveys the sheet;

a guide portion provided above the stack portion;

a second feed member that is provided above the stack portion and that is capable of feeding a sheet guided by the guide portion toward the separation member;

a moving member movable to a protruded position where the moving member is protruded toward the guide portion and a retracted position where the moving member is retracted from the protruded position toward the separation member; and a control unit that controls the first feed member, the second feed member, and the moving member, wherein the second feed member feeds the sheet guided by the guide portion in a state in which the moving member is positioned in the protruded position, wherein the separation member is capable of moving between a contact position in which the separation member abuts against the conveyance member, and a separated position in which the separation member is separated from the conveyance member, and wherein the control unit feeds the sheet with the second feed member in a state in which the first feed member is retracted upwards, the moving member is positioned in the protruded position, and the separation member is separated from the conveyance member.

* * * * *